US006528109B1

(12) United States Patent
Filev et al.

(10) Patent No.: US 6,528,109 B1
(45) Date of Patent: Mar. 4, 2003

(54) INTEGRATED PAINT QUALITY CONTROL SYSTEM

(75) Inventors: Dimitar P. Filev, Novi, MI (US); Steve A. Weiner, Ann Arbor, MI (US); P. Tomas Larsson, Canton, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/661,514

(22) Filed: Sep. 13, 2000

(51) Int. Cl.[7] ..... B05D 1/02

(52) U.S. Cl. ..... 427/9; 427/8; 427/421; 427/444; 118/665; 118/676; 118/679; 118/712; 118/313; 118/314

(58) Field of Search ..... 427/8, 9, 421, 427/444; 118/665, 676, 679, 712, 313, 314, DIG. 7

(56) References Cited

U.S. PATENT DOCUMENTS

| | | | | |
|---|---|---|---|---|
| 3,925,650 A | | 12/1975 | Brown | |
| 4,114,136 A | | 9/1978 | D'Albora | |
| 4,702,931 A | * | 10/1987 | Falcoff | 427/10 |
| 4,953,147 A | | 8/1990 | Cobb | |
| 4,977,853 A | * | 12/1990 | Falcoff et al. | 118/665 |
| 5,043,927 A | | 8/1991 | Jackson | |
| 5,091,647 A | * | 2/1992 | Carduner et al. | 250/341 |
| 5,142,648 A | * | 8/1992 | Fitts et al. | 364/551.01 |
| 5,356,334 A | | 10/1994 | Gray | |
| 5,448,503 A | | 9/1995 | Morris et al. | |
| 5,634,975 A | | 6/1997 | Josefsson | |
| 5,847,963 A | * | 12/1998 | Gaiski | 364/479.14 |
| 5,959,211 A | | 9/1999 | Wagner et al. | |
| 6,067,509 A | | 5/2000 | Gaiski | |
| 6,149,071 A | * | 11/2000 | MacCallumMhor et al. | 239/67 |
| 6,484,121 B1 | * | 11/2002 | Filev et al. | 702/170 |

FOREIGN PATENT DOCUMENTS

| | | |
|---|---|---|
| WO | WO 92/19933 | 11/1992 |

* cited by examiner

*Primary Examiner*—Katherine A. Bareford
(74) *Attorney, Agent, or Firm*—Damian Porcari

(57) ABSTRACT

An integrated paint quality control (IPQC) system for feedback control of paint process for painting vehicle bodies includes a film thickness sensor system for measuring paint film thickness of the painted bodies. The IPQC system also includes a control system communicating with the film thickness sensor system for receiving information of the paint film thickness and combining the paint film thickness information with paint automation parameters on a vehicle identification number (VIN) basis of the painted bodies to control the paint process.

9 Claims, 7 Drawing Sheets

| | |
|---|---|
| $\underline{U_{al}}$ = (FR_1.1_1,HV_1.1_1,SA_1.1_1,BS_1.1_1, | (BELL 1.1 SPRAY ZONE 1) |
| FR_1.1_2,HV_1.1_2,SA_1.1_2,BS_1.1_2, | (BELL 1.1 SPRAY ZONE 2) |
| .... | |
| FR_1.1_10,HV_1.1_10,SA_1.1_10,BS_1.1_10, | (BELL 1.1 SPRAY ZONE 10) |
| FR_1.2_1,HV_1.2_1,SA_1.2_1,BS_1.2_1,, | (BELL 1.2 SPRAY ZONE 1) |
| FR_1.2_2,HV_1.2_2,SA_1.2_2,BS_1.2_2,, | (BELL 1.2 SPRAY ZONE 2) |
| .... | |
| FR_1.2_10,HV_1.2_10,SA_1.2_10,BS_1.2_10, | (BELL 1.2 SPRAY ZONE 10) |
| .... | |
| FR_1.4_1,HV_1.4_1,SA_1.4_1,BS_1.4_1,, | (BELL 1.4 SPRAY ZONE 1) |
| FR_1.4_2,HV_1.4_2,SA_1.4_2,BS_1.4_2,, | (BELL 1.4 SPRAY ZONE 2) |
| .... | |
| FR_1.4_10,HV_1.4_10,SA_1.4_10,BS_1.4_10, | (BELL 1.4 SPRAY ZONE 10) |
| FR_4.1_1,HV_4.1_1,FA_4.1_1,AA_4.1_1,, | (RECIP 4.1 SPRAY ZONE 1) |
| FR_4.1_2,HV_4.1_2,FA_4.1_2,AA_4.1_2,, | (RECIP 4.1 SPRAY ZONE 2) |
| .... | |
| FR_4.1_10,HV_4.1_10,FA_4.1_10,AA_4.1_10, | (RECIP 4.1 SPRAY ZONE 10) |
| FR_4.2_1,HV_4.2_1,FA_4.2_1,AA_4.2_1,, | (RECIP 4.2 SPRAY ZONE 1) |
| FR_4.2_2,HV_4.2_2,FA_4.2_2,AA_4.2_2,, | (RECIP 4.2 SPRAY ZONE 2) |
| .... | |
| FR_4.2_10,HV_4.2_10,FA_4.2_10,AA_4.2_10) | (RECIP 4.2 SPRAY ZONE 10) |
| $\underline{Y_{cl}}$ = (FB_1,FB_2, ...,FB_ul, | (FB MEASURED IN nl LOCATIONS) |
| G_1,DOI_1,OP_1,G_2,DOI_2,OP_2, | (QMS MEASURED IN nql LOCATIONS) |
| G_nql,DOI_nql,OP_1) | |

Fig-5

INTEGRATED PAINT QUALITY CONTROL SYSTEM

BACKGROUND OF THE INVENTION

1. Field of the Invention

The present invention relates generally to paint systems for vehicles and, more specifically, to an integrated paint quality control system for feedback control of paint process for painting bodies of vehicles.

2. Description of the Related Art

The application of paint to a body of a vehicle is a sensitive process. The quality, durability and color matching of the paint are critical in producing a high quality product, and therefore require significant quality control efforts. A paint booth is used to apply the paint to the vehicle bodies. The thickness of the film build measured from the vehicle body and quality measurement system (QMS) quality characteristics (gloss, distinctiveness of image, orange peel, and their aggregated value) are the outputs of the paint process. However, the film thickness and the QMS quality characteristics of the paint may vary with location due to geometric differences of the vehicle body. These output characteristics also vary from vehicle body to vehicle body because of process variability.

Although most of the process parameters (bell speed, paint flows, humidity, booth air flows) are controlled by feedback control systems, the paint process as a system is not automatically controlled. As a result, it is desirable to provide an automatic integrated paint quality control system that monitors and supervisory controls the paint process in terms of paint quality characteristics—film thickness and QMS. It is also desirable to provide an integrated paint quality control system that minimizes the number of vehicles that lack paint thickness uniformity in painting of vehicle bodies. It is further desirable to provide an integrated paint quality control system that allows for quick identification of paint variability and immediately responds with proper adjustment of settings for a paint booth for painting vehicle bodies.

SUMMARY OF THE INVENTION

Accordingly, the present invention is an integrated paint quality control (IPQC) system for feedback control of paint process for painting vehicle bodies including a film thickness sensor system for measuring paint film thickness of the painted bodies. The IPQC system also includes a control system communicating with the film thickness sensor system for receiving information of the paint film thickness and combining the paint film thickness information with paint automation parameters on a vehicle identification number (VIN) basis of the painted bodies to control the paint process.

One advantage of the present invention is that an integrated paint quality control system is provided for feedback control of a paint process for painting vehicle bodies. Another advantage of the present invention is that the integrated paint quality control system does not eliminate or change existing feedback control systems that control most of the paint process parameters. Yet another advantage of the present invention is that the integrated paint quality control system functions as a supervisory control system that updates their set points based on the output process parameters—film thickness and QMS characteristics. Still another advantage of the present invention is that the integrated paint quality control system monitors and supervisory controls the paint process in terms of paint uniformity. A further advantage of the present invention is that the integrated paint quality control system allows for quick identification of paint variability due to changes in paint booth environment, paint equipment, and paint characteristics and immediately responds for proper adjustment of automation equipment settings. Yet a further advantage of the present invention is that the integrated paint quality control system is capable of identifying on-line paint thickness variability immediately after a vehicle has been painted. Still a further advantage of the present invention is that the integrated paint quality control system automatically analyzes the cause for the variation and calculates paint process parameter settings of local paint automation equipment that can compensate for this variation. Another advantage of the present invention is that the integrated paint quality control system minimizes the number of vehicles that lack paint thickness uniformity. Yet another advantage of the present invention is that the integrated paint quality control system keeps track of the paint process parameters that are out of specification and identifies equipment failures. Still another advantage of the present invention is that the integrated paint quality control system summarizes all paint process data and links to a vehicle identification number of the vehicle bodies, which provides for process/quality data mining and optimization in a later stage.

Other features and advantages of the present invention will be readily appreciated, as the same becomes better understood, after reading the subsequent description taken in conjunction with the accompanying drawings.

BRIEF DESCRIPTION OF THE DRAWINGS

FIG. 5 is a diagrammatic view of a structure of input and output vectors for the IPQC system of FIG. 1.

DESCRIPTION OF THE PREFERRED EMBODIMENT(S)

Figure 1:
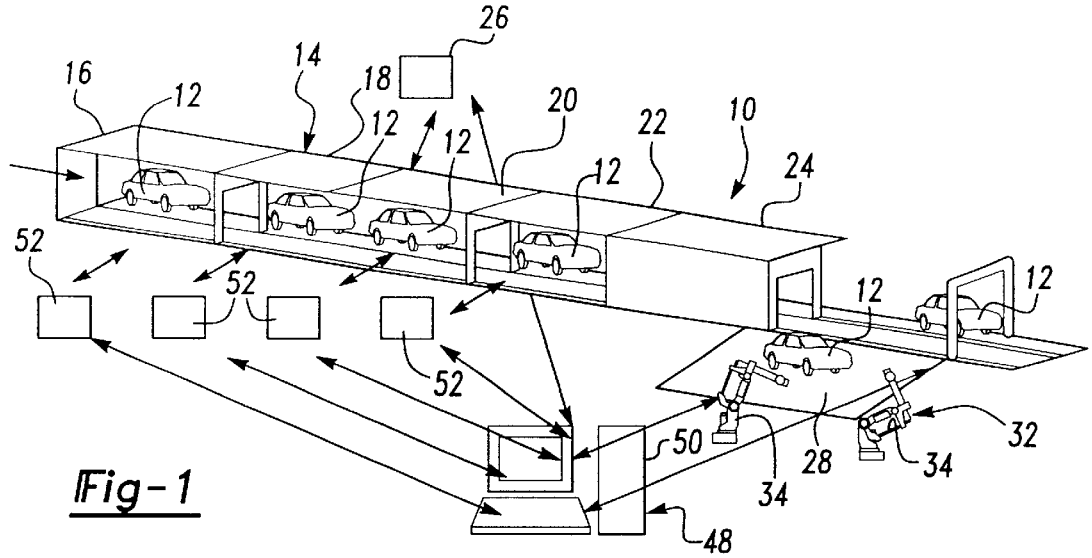
FIG. 1 is a diagrammatic view of an integrated paint quality control (IPQC) system, according to the present invention.

Referring to the drawings and in particular FIG. 1, one embodiment of an integrated paint quality control (IPQC) system 10, according to the present invention, is illustrated for painting bodies 12. The painted bodies 12 are vehicle bodies for motor vehicles (not shown). The IPQC system 10 includes a paint booth, generally indicated at 14. The paint booth 14 includes a plurality of zones 16,18,20,22,24. The paint booth 14 includes a base coat (B/C) bells zone 16 and a base coat reciprocation (B/C Recips) zone 18 adjacent the B/C bells zone 16. The paint booth 14 also includes a first clear coat (C/C) bells zone 20 adjacent the B/C Recips zone 18 and a second C/C bells zone 22 adjacent the first C/C bells zone 20. The paint booth 14 includes an oven zone 24 adjacent the second C/C bells zone 22 for drying the applied paint on the painted bodies 12. The paint booth 14 includes an airflow control 26 such as fans and dampers to control the airflow in the zones 16,18,20,22,24. It should be appreciated that the paint booth 14 is conventional and known in the art.

The IPQC system 10 includes a conveyor station or measurement cell 28 located adjacent to the end of the oven zone 24 of the paint booth 14 for automatically measuring paint film thickness on the painted bodies 12. The system 10 includes a conveyor control system (not shown) having a conveyor (not shown) for moving the painted bodies 12 off-line to and from the cell 28 and a conveyor (not shown) of the paint booth 14.

The IPQC system 10 also includes a contact/noncontact film thickness sensor system 32 for measuring paint film thickness at a plurality of locations on the painted bodies 12 off-line in the cell 28. An example of a system of this type is the System for Automatically Measuring Paint Film Thickness (AutoPelt), which is disclosed in co-pending application, Ser. No.: 09/657,210, filed: Sep. 7, 2000 to Filev et al, now U.S. Pat. No. 6,484,121. It should be appreciated that other types of contact/noncontact film thickness sensor systems can be used.

The film thickness sensor system 32 includes at least one, preferably a plurality of robots 34 and a multiple sensor tool 36 attached to each of the robots 34. The sensor tool 36 includes at least one, preferably a plurality of contact/noncontact film thickness (PELT) gauges 38 and a sensor alignment fixture 40 that positions the film thickness gauges 38 to the painted bodies 12. The sensor tool 36 on the robots 34 aligns the film thickness gauges 38 to specific coordinates on each body panel of the painted bodies 12 that are aligned with vertical and horizontal paint applicators (not shown) in the paint booth 14 that apply paint on the bodies of the vehicles. An example of such a sensor tool 36 is disclosed in U.S. Pat. No. 5,959,211 to Wagner et al., the disclosure of which is hereby incorporated by reference.

Figure 3:
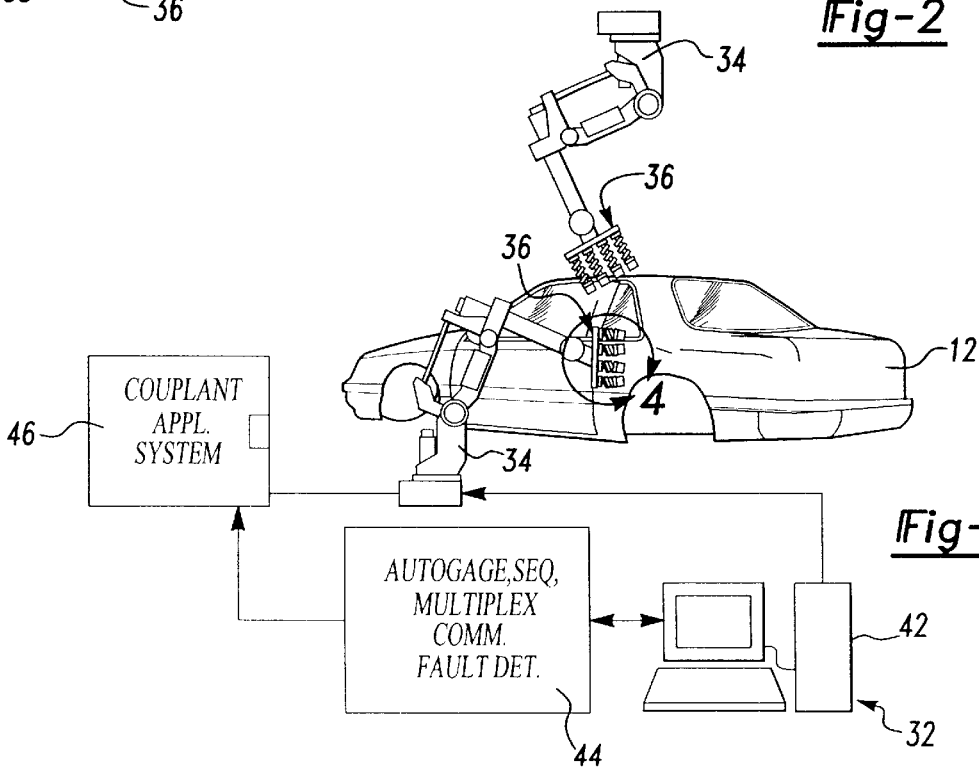
FIG. 3 is a diagrammatic view of another portion of the IPQC system of FIG. 1.

Referring to FIG. 3, the film thickness sensor system 32 also includes a computer system 42, which includes a computer having a memory, a processor, a display, and user input mechanism, such as a mouse or keyboard, connected to the robots 34. The film thickness sensor system 32 includes sensor controls 44 such as controllers (not shown) equipped with automatic sequencing/stability software connected to the computer system 42. The sensor controls 44 also include multiplex communication and fault detection. The film thickness sensor system 32 further includes a liquid coupling application system 46 such as robots 34 and controllers (not shown) connected to the sensor controls 44 to control the movement of the sensor alignment fixture 40 over the painted bodies 12 and for film thickness measurement. It should be appreciated that the film thickness sensor system 32 communicates with the conveyor control system to coordinate the movement of painted bodies 12 to and from the cell 28.

Figure 2:
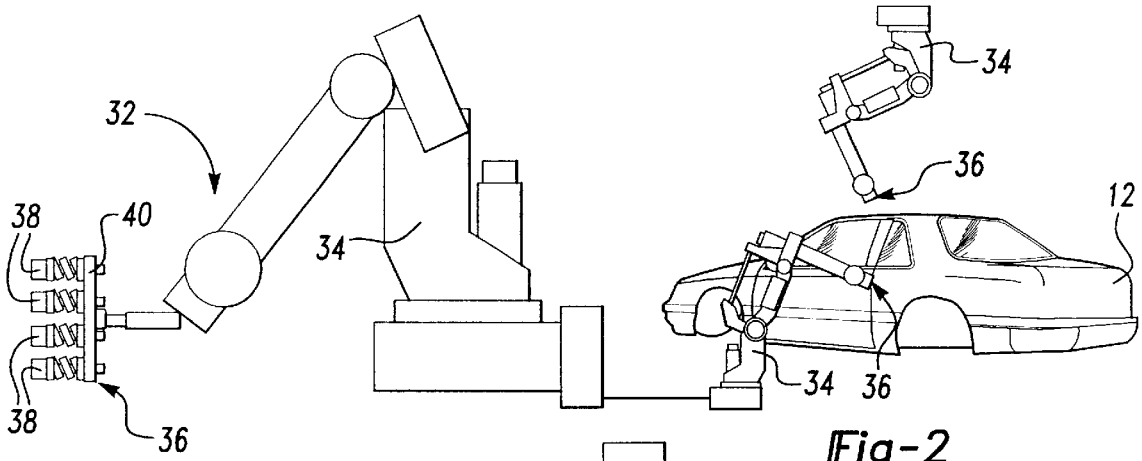
FIG. 2 is a diagrammatic view of a portion of the IPQC system of FIG. 1.

Referring to FIGS. 1 through 3, the IPQC system 10 includes a control system 48 connected to the film thickness sensor system 32, which receives paint film thickness information from the film thickness sensor system 32 and combines the paint film thickness information with paint process parameters on a vehicle identification number (VIN) basis. The control system 48 includes a computer system 50, which includes a computer having a memory, a processor, a display, and user input mechanism, such as a mouse or keyboard. The control system 48 collects all inputs such as applicator flow rates, shaping air, high voltage, bell speed, and outputs information such as film thickness distribution over the painted body 12, for each painted body 12 that is measured.

The IPQC system 10 further includes a plurality of controllers, such as a programmable logic controller (PLC) 52, connected to the control system 48, which receives the output information from the control system 48. The PLCs 52 control paint automation equipment such as the paint applicators, airflow control, etc., of the paint booth 14. It should be appreciated that there is a significant time difference between the actual paint application and the film thickness measurement. It should further be appreciated that the conveyor control system reads the VIN of the painted body 12 and communicates with the control system 48.

Figure 4:
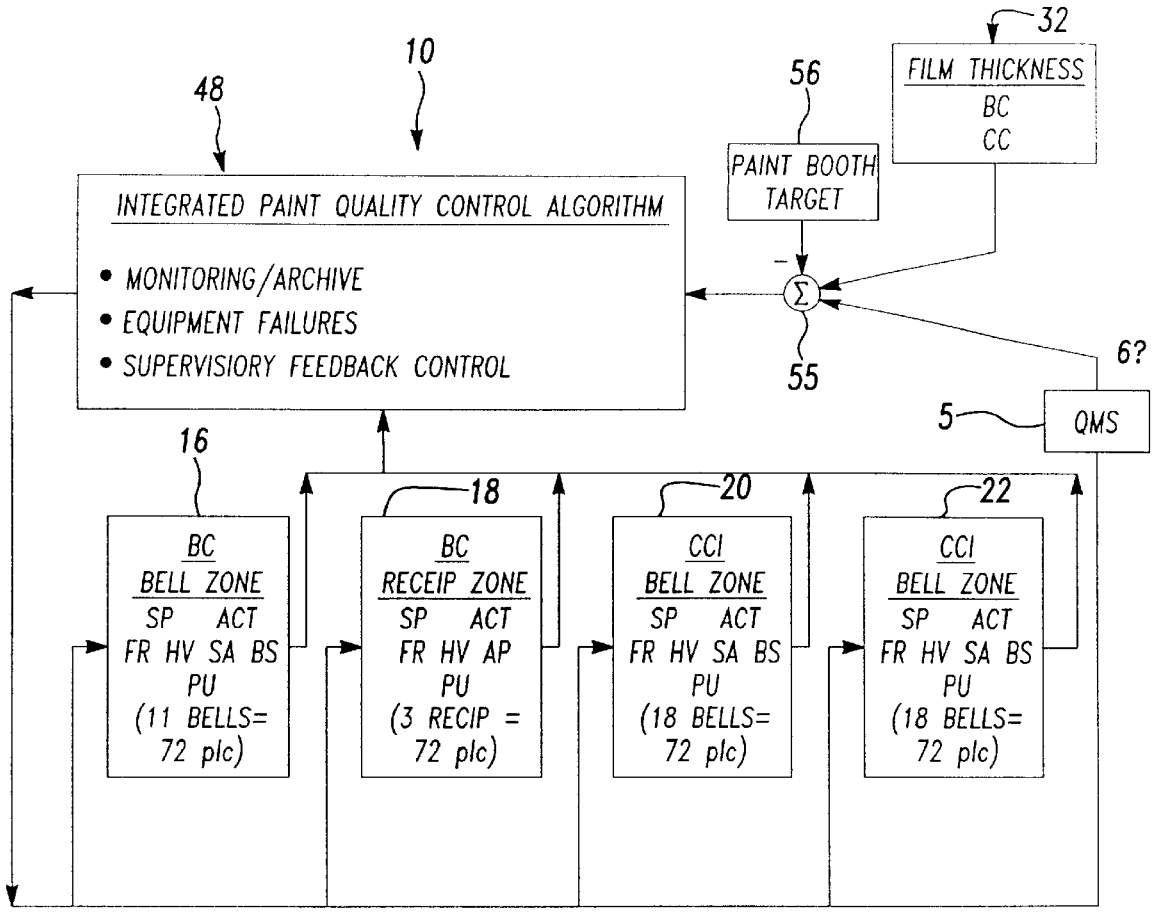
FIG. 4 is a block diagrammatic view of the IPQC system of FIG. 1.

Referring to FIG. 4, a block diagram of the IPQC system 10 is shown. In general, the control system 48 instantaneously reads the settings of the paint process parameters (bell/gun paint flows, shaping air, atomizing air, bell speed, high voltage) from the local PLCs 52 of the individual zones 16,18,20,22 of the paint booth 14 and communicates it to the IPQC system 10 together with the VIN for the painted bodies 12. When a painted body 12 enters the cell 28, the fixture 40 is placed on desired coordinates of the painted body 12. The computer system 42 of the film thickness sensor system 32 communicates with the software of the sensor controls 44 until all designated areas are measured. The film thickness measurement information is then sent back to the control system 48 to adjust the paint application parameters for the individual zones 16,18,20,22 of the paint booth 14.

In the IPQC system 10, paint film thickness information, quality measurement system (QMS) information in block 54, and paint booth target information in block 56 are sent to a summation 58, which is transmitted to the control system 48. In the control system 48, the paint process parameter information is compared with the on-line film thickness measurement information and QMS information. Paint process parameters and film thickness/QMS information are synchronized based on the VIN of the painted body 12. Based on a mean square error (MSE) between the actual readings and their target values, the IPQC system 10 on-line adjusts the set points of the paint process variables in direction of minimizing the MSE. The control system 48 outputs new set points to the controllers 52, which control the paint application equipment in the paint booth 14. It should be appreciated that SP is the set-point, ACT is the actual process output, FR is the paint flow rate, HV is the high voltage, SA is the shaping air, BS is the bell speed, PU is the paint usage, and AA is the atomizing air are the parameters of the paint application process. It should be appreciated that a control algorithm, according to the present invention, is a software program stored on the computer of the computer system 50 to be carried out on the computer system 50 to control the paint booth 14 as subsequently described in connection with FIG. 7.

Referring to FIG. 5, paint film on painted body 12 is decomposed into a number of subsystems, e.g.,—left vertical side base coat subsystem—$S_{nl}$ right vertical side base coat subsystem—$S_{nr}$ horizontal surfaces base coat subsystem—$S_{nh}$ left vertical side clear coat subsystem—$S_{cl}$ right vertical side clear coat subsystem—$S_{cr}$ horizontal surfaces clear coat subsystem—$S_{ch}$. It should be appreciated that this is just an example of a possible decomposition into a number of subsystems, and that the system has the flexibility to be separated into more subsystems of less complexity, or joined into fewer subsystems of higher complexity. It should also be appreciated that any input can be excluded from being included in a subsystem and controlled manually by an operator if so desired.

Bell/gun parameters of the paint applicators that effect each subsystem form an input vector, i.e., the input vector $u_{nl}$ of subsystem $S_{nl}$ could include the bell flow rate (FR), bell high voltage (HV), bell shaping air (SA) and bell speed (BS) for all bell zones that are targeted on the left side—(1.1–1.4) and the recip flow rate (FR), recip fan air (FA), recip atomizing air (AA) and recip high voltage (HV) for all recip guns—(4.1–4.2) per each spray zone (in this example 10 spray zones are considered). The structure of the input vector $u_{nl}$ of subsystem $S_{nl}$ (left vertical side base coat subsystem) is shown in FIG. 5. Input vectors $u_{nr}$ and $u_{nh}$ have analogous structure but include bells 2.1–2.4, recips 5.1–5.2 and bells 3.1–3.4, recips 6.1–6.2, respectively. Input vectors $u_{cl}$, $u_{cr}$, $u_{ch}$ for the clear coat subsystems—$S_{cl}$, $S_{cr}$, $S_{ch}$ include the parameters of clear coat bells 1.1–1.7, 2.1–2.7, 3.1–3.7. Output vectors $y_{nl}$, $y_{nr\ and\ ynh}$ are of dimensions nl, nr and nh, where nl, nr and nh are the number of measurements obtained from the left side, the right and on the horizontal surfaces of the painted body 12. The measurements obtained can be film build thickness and/or QMS parameters (Gloss, DOI, Orange Peel). The structure of output vector $y_{nl}$ is shown in FIG. 5.

Figure 8A:
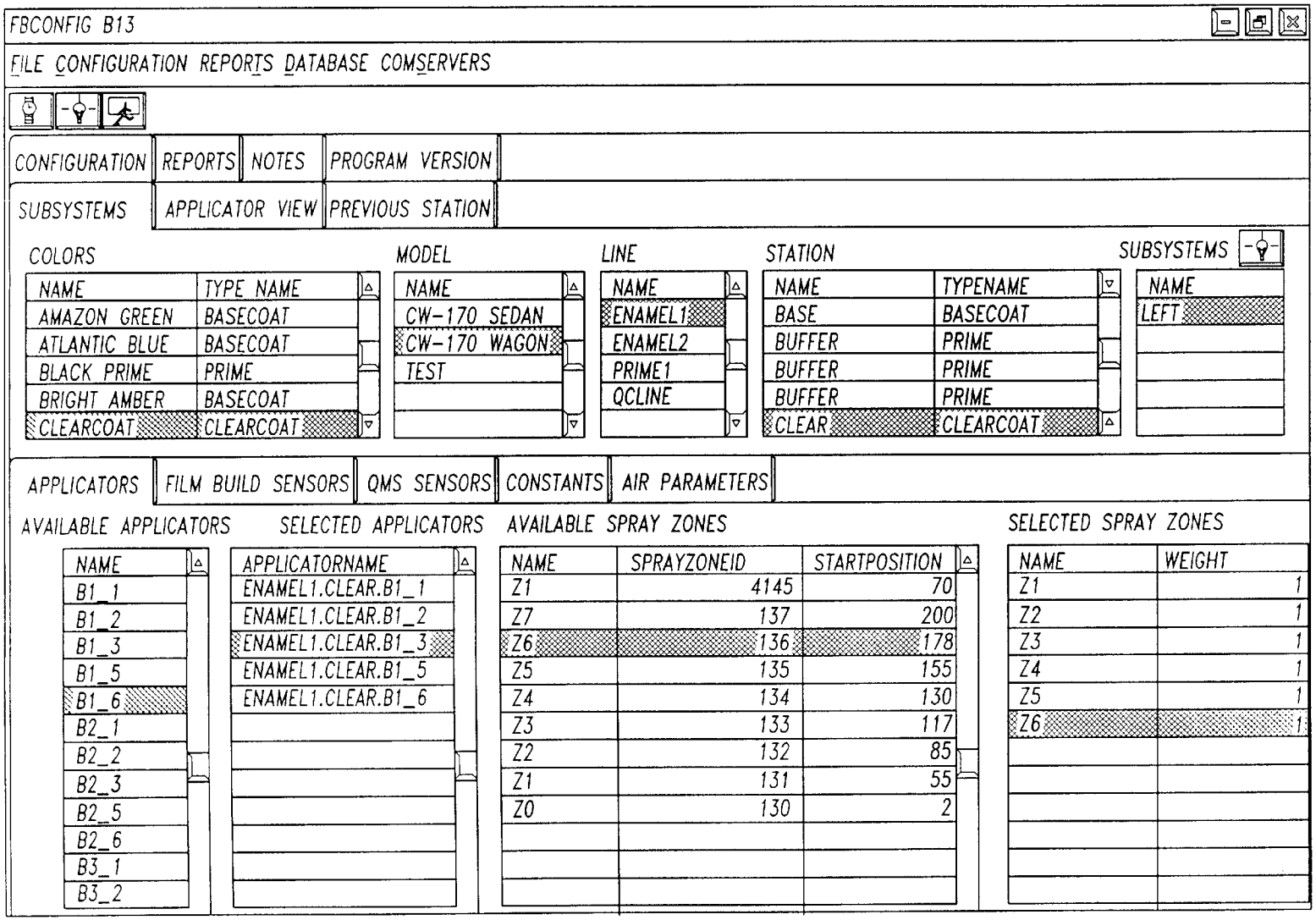
FIGS. 8A, 8B, and 8C are views of screen displays from software used to configure the subsystems for the control logic in FIG. 7.
Figure 8B:
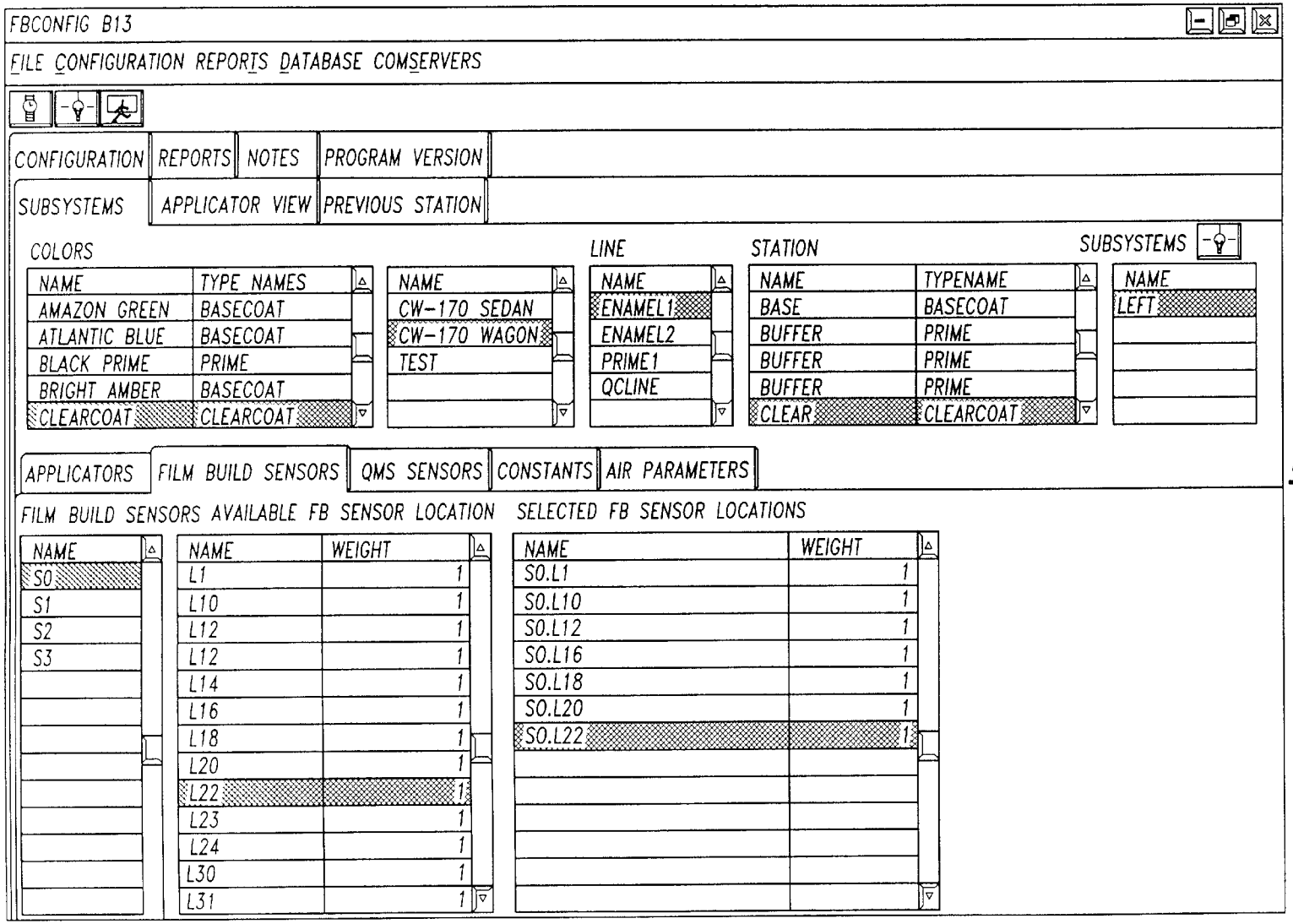
Figure 8C:
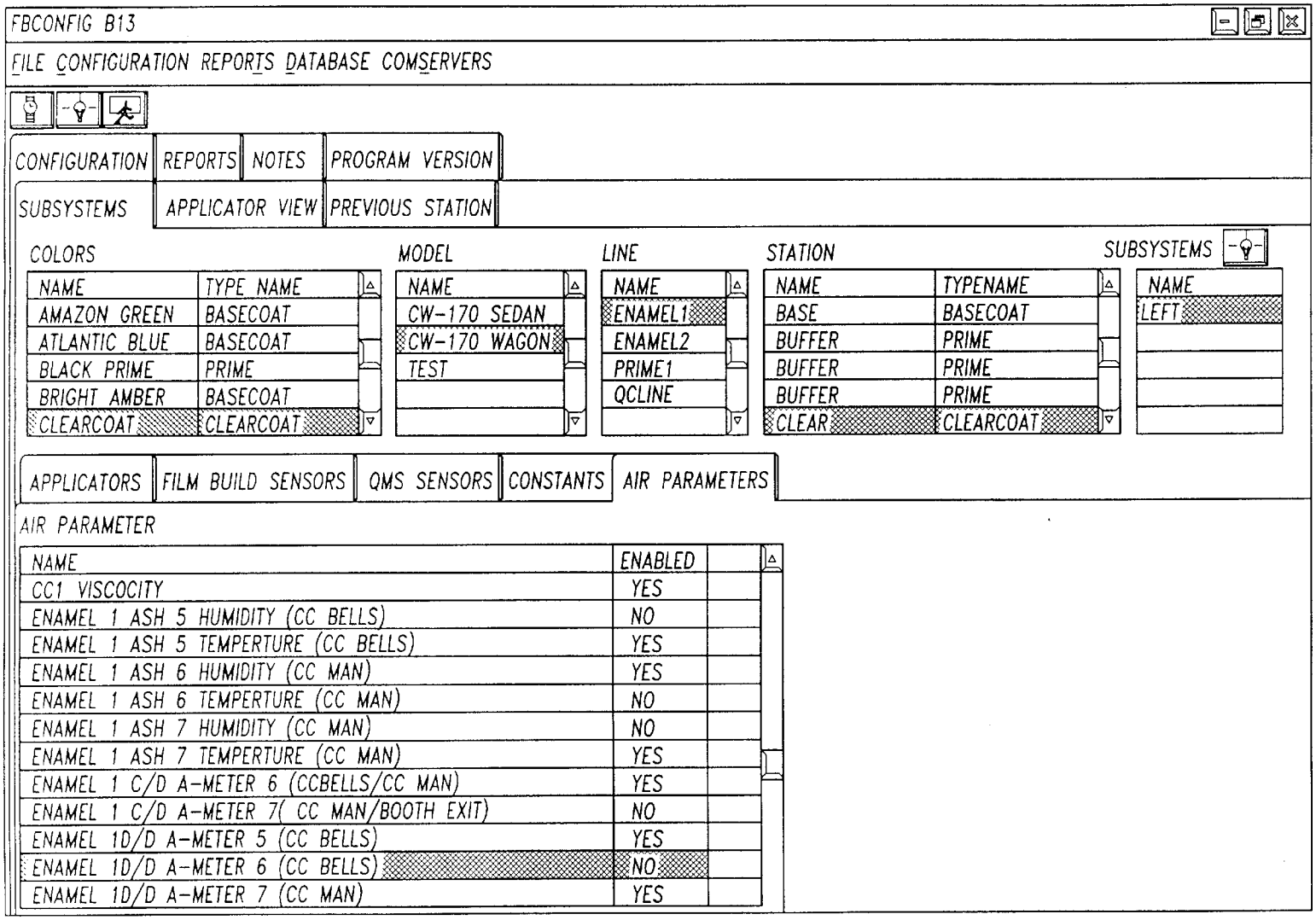

The structure of the input and output vectors to each subsystem can be modified online during the paint process or off-line during paint process downtime by using a software to update the definitions of the subsystems that are stored in electronic memory. FIG. 8A shows one of the screens of this software used to determine what inputs that should be included for a particular subsystem. The software will list all bells and zones that can possibly be included in a particular subsystem, as well as what bells and zones that are currently included in the subsystem. For the example shown in FIG. 8A, the subsystem called "left" controls the clear coat zone for painted bodies 12 of model CW-170 Wagon being painted in paint booth Enamell. The selected bells are B1_1, B1_2, B1_3, B1_5, and B1_6. For bell B1_3, Zones 1 through 6 have been included in the subsystem. Similarly, the software has screens to determine what outputs (film thickness and QMS measuring points) (FIG. 8B), and what environmental parameters (FIG. 8C), that could be considered for a particular subsystem. For the example, in FIG. 8B, sensors L1, L10, L12, L16, L18, L20, and L22 have been included in the subsystem "left". For the same example, FIG. 8C shows that viscosity ASH 5 temperature, ASH 6 humidity, ASH 7 Temperature, C/D A-meter 6, D/D A-meter 5 and D/D A-meter 7 have been included as environmental variables in the subsystem "left". If a definition of a subsystem is changed, this will automatically be detected by the IPQC system 10 and the inputs/output vectors used to control that subsystem are automatically updated. It should be appreciated that any process input (bell/gun parameters) not included in any subsystem will be controlled by an operator in the same way that it is conventionally performed in the art.

Figure 6A:
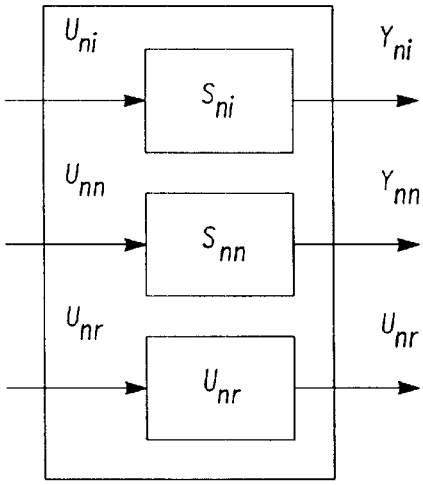
FIG. 6A is a diagrammatic view of a base coat subsystem of the IPQC system of FIG. 1.
Figure 6B:
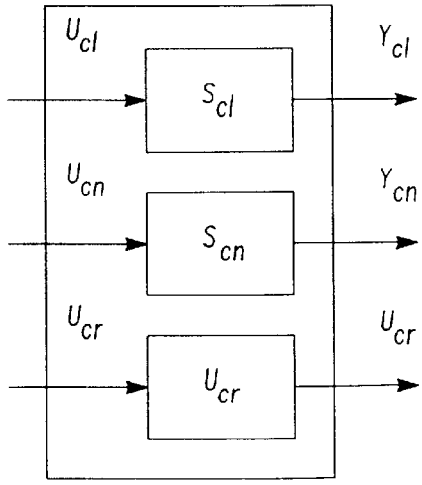
FIG. 6B is a diagrammatic view of a clear coat subsystem of the IPQC system of FIG. 1.

Referring to FIGS. 6A and 6B, an example of a possible subsystem configuration for paint film on the painted body 12 is represented as six (6) decoupled subsystems. Subsystems $S_{nl}$, $S_{nn}$, and $S_{nr}$ represent the basecoat and subsystems $S_{cl}$, $S_{cn}$, and $S_{cr}$ represent the clear coat on the left vertical, horizontal, and right vertical side of the vehicle body.

Desired film thickness and QMS parameters can be achieved for different combinations of paint process variables. The values of the paint process variables that would drive the output vectors (film thickness and QMS parameters) to the desired targets can be determined by inverting the nonlinear mappings that approximate subsystems $S_{n1}$, $S_{nn}$, $S_{nr}$, $S_{cl}$, $S_{cn}$, and $S_{cr}$. The inversion problem is solved as a constrained optimization problem since there is a number and technological and equipment constraints on the paint process variables. For example, all variables have upper and lower limits that are determined by the paint equipment design. In addition, additional constraints can be applied to the process inputs to make sure that the IPQC system 10 only makes small changes about the initial settings of the process parameters. This is especially useful during testing and startup before enough data is available to have accurate models 72 (FIG. 7) for the subsystems.

Figure 7:
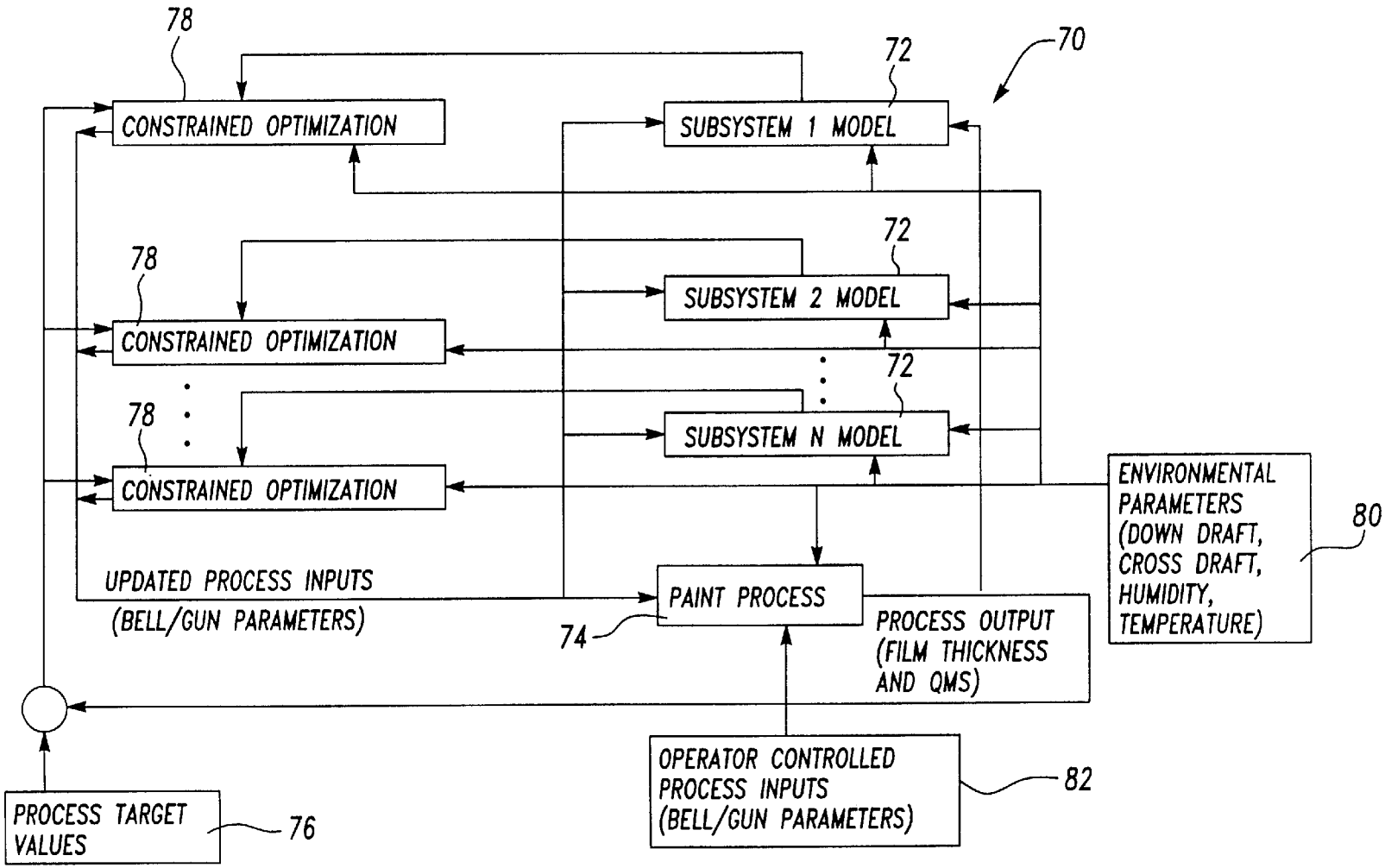
FIG. 7 is a block diagram of control logic used with the IPQC system of FIG. 1.

Referring to FIG. 7, a block diagram of the control algorithm 70 is shown. In the control algorithm 70, for each new sample, which is a set of input/output vectors linked to the same VIN (process parameters, set-points, B/C, C/C thickness and QMS), the control algorithm 70 updates a model 72 for each subsystem. These models 72 approximate the input/output relationship of the paint process 74. Each time new process outputs (paint film thickness and QMS) are measured, output vectors $Y_{nl}$, $Y_{nr}$, $Y_{nh}$, $Y_{cl}$, $Y_{cr}$, and $Y_{ch}$ (B/C, C/C film builds and QMS) are compared to process target values 76 and a constrained optimization 78 is applied to calculate the optimal input vectors $u_{nl}$, $u_{nr}$, $u_{nh}$, $u_{cl}$, $u_{cr}$, and $u_{ch}$ (paint process parameters) or new set points that would drive the film builds and QMS to their target values 76. The new set points are applied to the paint process 74. It should be appreciated that the control algorithm 70 may include environmental parameters such as down draft, cross draft, humidity, and temperature as inputs into the models 72 and constrained optimization 78. It should also be appreciated that the control algorithm 70 may include operator controlled process inputs such as bell/gun parameters as an input into the paint process 74.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of operating an integrated paint quality control (IPQC) system for painting vehicle bodies by a paint process, said method comprising the steps of:

measuring paint film thickness of painted vehicle bodies;

monitoring the paint process for the painted vehicle bodies; and retrieving information of paint process parameters and measured paint film thickness and storing the retrieved information based on a vehicle identification number basis; and applying a control algorithm to the retrieved information to minimize a distance measure between an output vector and a vector of corresponding output targets for the paint process parameters subject to given constraints on inputs of the paint process.

2. A method as set forth in claim 1 wherein the paint process parameters include an input vector of the paint process comprising current settings of all bells/guns: bell flow rates (FR), bell high voltages (HV), bell shaping air (SA) and bell speeds (BS) for all base and clear coat bells, reciprocator flow rates (FR), reciprocator fan air (FA), reciprocator atomizing air (AA) and reciprocator high voltages (HV) for all reciprocators for all flow zones along the vehicle bodies.

3. A method as set forth in claim 1 wherein the paint process parameters include an output vector of the paint process comprising base/clear coat film thickness and quality measurement system quality characteristics measured at specified locations over the vehicle bodies.

4. A method as set forth in claim 1 wherein the paint process parameters include an environmental parameters vector of the paint process comprising downdraft and cross-draft airflow velocities, booth air temperature and humidity, and paint viscosity.

5. A method as set forth in claim 1 including the step of decomposition of the paint process into a set of controllable subsystems, where the control system controls each subsystem separately.

6. A method as set forth in claim 5 including the step of creating, changing existing, and deleting the subsystems during the paint process, or during paint process down time by means of updating subsystem definitions.

7. A method as set forth in claim 5 including the step of automatically detecting changes in subsystem definitions, and changing an input vector and output vector for the subsystems to match the changed subsystem definitions.

8. A method as set forth in claim 1 including the step of imposing input constraints for the control system to ensure that the control system only makes relatively small changes from initial values of the paint process parameters.

9. A method of operating an integrated paint quality control (IPQC) system for painting vehicle bodies by a paint process, said method comprising the steps of:

measuring paint film thickness of painted vehicle bodies;

monitoring the paint process for the painted vehicle bodies;

retrieving information of paint process parameters and measured paint film thickness and storing the retrieved information based on a vehicle identification number basis;

comparing outputs of the paint process parameters to paint process target values for the paint process parameters;

applying a control algorithm to calculate new set points to drive the film thickness to the target values; and applying the new set points to the paint process parameters.

* * * * *